US008327902B2

(12) United States Patent
Lam

(10) Patent No.: US 8,327,902 B2
(45) Date of Patent: Dec. 11, 2012

(54) TAPE DELIVERY SYSTEM FOR A TAPE APPLICATOR

(75) Inventor: Joe Augustine S. T. Lam, Vancouver (CA)

(73) Assignee: Lamus Enterprises Inc, Vancouver (CA)

( * ) Notice: Subject to any disclaimer, the term of this patent is extended or adjusted under 35 U.S.C. 154(b) by 334 days.

(21) Appl. No.: 12/801,346

(22) Filed: Jun. 4, 2010

(65) Prior Publication Data

US 2011/0297322 A1 Dec. 8, 2011

(51) Int. Cl.

| | |
|---|---|
| ***B65C 1/00*** | (2006.01) |
| ***B65C 1/04*** | (2006.01) |
| *B32B 37/00* | (2006.01) |
| *B32B 38/00* | (2006.01) |

(52) U.S. Cl. ..... 156/486; 156/475; 156/477.1; 156/478; 156/479; 156/480; 156/487; 156/488; 156/489; 156/493; 156/510; 156/516; 156/517

(58) Field of Classification Search ..... 156/475, 156/477.1, 478–480, 486–489, 493, 510, 156/516, 517

See application file for complete search history.

(56) References Cited

U.S. PATENT DOCUMENTS

| | | | | |
|---|---|---|---|---|
| 4,592,188 | A * | 6/1986 | Marchetti | 53/136.4 |
| 4,640,731 | A | 2/1987 | Lerner et al. | |
| 4,642,157 | A | 2/1987 | Cavanagh | |
| 5,227,002 | A | 7/1993 | Faust et al. | |
| 5,735,101 | A * | 4/1998 | Shing-Tak Lam | 53/136.1 |
| 2009/0072071 | A1 * | 3/2009 | Lucht | 242/550 |

FOREIGN PATENT DOCUMENTS

| | | |
|---|---|---|
| EP | 0 259 241 | 9/1988 |

* cited by examiner

*Primary Examiner* — Mark A Osele
*Assistant Examiner* — Christopher C Caillouet
(74) *Attorney, Agent, or Firm* — C. A. Rowley

(57) ABSTRACT

An improved tape supply system particularly suited for use in a multifunction tape applicator for applying a front and/or back L-clips to a case wherein a dancer roll is operable to provide slack in the tape and a break is applied to facilitate cutting of the tape.

2 Claims, 5 Drawing Sheets

TAPE DELIVERY SYSTEM FOR A TAPE APPLICATOR

FIELD OF INVENTION

The present invention relates to an improved tape delivery system for a tape applicator for applying tapes to a case, more particularly to a delivery system for providing slack and stopping tension in the tape used in a multi-functional tape applicator for selectively applying closure tapes in different configurations such as L-clip and C-clip configurations

BACKGROUND OF THE PRESENT INVENTION

Equipment for applying tape in a C-clip configuration is very well known and is commonplace in the literature and the industry. C-clip configuration generally applies a continuous ribbon of tape starting on a leading face of a case or carton passing through the machine along the surface of the case facing the taper and at least partway along the trailing face of the case i.e. the ribbon of tape forms a C-shape.

L-clip configuration generally applies a ribbon of tape along two adjacent a faces of case e.g. around a corner of the case i.e. the ribbon of tape is formed into an L-shape.

"L"-clip taping fulfills the "sustainability" packaging requirements in material and cost-saving comparing to the common "C"-clip taping. The concept of L-clip taping is known attention is directed to U.S. Pat. No. 4,640,731 that employs 2 separate applicators one to apply an L clip to the leading end and the other to apply an L clip to the trailing end of the case. U.S. Pat. No. 4,642,157 applies an L-clip using and application roll to apply the tape to one wall of the case and then a separate wipe down roll to apply the tape to an adjacent surface of the case. This device can only apply an L clip to the leading end of the case. Similarly U.S. Pat. No. 5,227,002 provides a device that can apply a tape in an L-clip configuration to leading face only of a case.

Majority of carton closure do not require a continuous C-clip tape to seal the full length of the flaps, particularly carton package for the domestic business to business market where the tape sealed cartons are stacked, palletized and pallet wrapped with plastic film for shipping and storage.

An L-clip configuration of a sealing tape is ideal for light weight cartons; single hinged flap cartons; tray carton with top lid; half slotted case, etc.

The L-clips generally may be peeled off easily by hand without the use of box cutting knife, eliminating injuries and product damages when opening the carton with knife.

In general, the adhesion and the strength of the pressure sensitive tape material are strong enough to withstand the weight of the content inside the carton with only the front and the back L-clips tape on top or at the bottom of the carton.

C-clip taping provides a more secure and dust/inserts/tamper proof package. It is ideal for individual consumer package subject to multi-handling and or over-sea shipping.

Regardless of all the obvious benefits of "L"-clip taping, the "C"-clip tape applicators are much more simple, reliable and user-friendly. Mostly operate mechanically without power-driven. They can be removed from the machine for tape replenishing with no tools. Because of its simplicity; low cost; easy to use and low maintenance as well as its long history of taping method, the popularity of C-clip taping remains very strong in the industry.

The currently available L-clip tape applicators in the industry are dedicated for L-clip taping only, mostly operated by air cylinder with electrical control, meaning external sensors wiring and two power sources are required. Mechanical nonpowered L-clip tape applicators with separated front and back units are too complicated since it has two individual tape rolls and other duplicated apparatus (see U.S. Pat. No. 4,640,731 referred to above). They are not particularly user-friendly.

In general, L-clip tape applicators are much larger in size than conventional C-clip applicators and require more mounting space, extra wiring, special installation and a longer drive system to accommodate the tape applicator. Since the known L-clip tape applicators are dedicated for a single function, the carton sealing machine is dedicated for "L"-clip taping only. In situation where it is required to change the taping configuration, it is necessary to replace the entire tape applicator accordingly. The machine has to be shut down for the removal and disconnection of the existing unit and the installation, connection and set up of a different tape applicator.

The concept of a multifunctional taper capable (with minor adjustments) to apply a tape selectively in a C-clip or L-clip configuration is taught in Applicant's co-pending U.S. patent application Ser. No. 12/318,877 filed: Jan. 12, 2009 inventor Joe Lam the disclosure of which is incorporated herein by reference. This machine has the capability of selectively applying a C-clip, a L-clip or, a pair of L-clips (a leading and trailing L-Clip applied respectively to the lead or trailing end of the case being sealed or closed).

EPC application 0 259 241 describes a tape extender for extending the length of tape between a drag roll and the source of the tape (tape roll) and is an improvement for an apparatus for folding over the leading end of the tape to be applied to seal a carton in the conventional manner i.e. as a C-shaped tape application. This EPC Application 0 259 241 is specifically related to an apparatus for applying a length of tape and employs a drag between the tape supply roll and the lead applicator and operates to tension the tape between the supply roll and the drag as the tape is being pulled by movement of the case being taped and with the cut-off knife in inactive position and then to relieve said tension in the tape when the when the tape is cut by. cut off knife 150 in active cutting position.

The present invention provides an improved tape delivery system that is particularly suitable for delivering tape to a tape applicator for applying an L-clip to the case and provides a system for clamping and providing slack in the tape (extending the tape) being delivered to the point of application to the case.

BRIEF DESCRIPTION OF THE PRESENT INVENTION

It is an object of the present invention to provide an improved tape delivery system adapted to clamp the tape and to extend the tape to provide slack in the tape being delivered from a supply roll to a tape applicator for applying L-clip tape sections and in particular provides an improved delivery system for delivering tape to a multifunctional machine as described in the said U.S. patent application Ser. No. 12/318,877 filed: Jan. 12, 2009 (incorporated herein by reference) which is capable of changing from C-clip to front and/or back L-clips depending on the carton sealing requirement.

Broadly the present invention relates to a tape supply system for a tape applicator for applying a closing tape ribbon to a carton comprising a frame for said tape applicator, a source of tape, a plurality of guide rolls arranged to define a tape path for a tape ribbon from said tape supply to an applicator for applying said tape to a case, one of said guide rolls being a dancer roll mounted to rotate on a first axis mounted on a dancer arm adjacent to one end of said dancer arm, said dancer arm being pivotably mounted on said frame on a second axis parallel to said first axis and positioned spaced from said first axis, a spring biasing said dancer arm to rotate in a counterclockwise direction around said second axis, a one way cam element pivotably mounted on a pivotal axis on said dancer arm and located between said first and second axis and a second spring biasing said cam to rotate in an anticlockwise direction on said pivotal axis, a one way clutch roll pivotably mounted on said frame on a third axis parallel to said first axis, said one way clutch roll permitting rotation to permit movement of said tape along said tape path from said tape supply toward said applicator, an applicator arm pivotably mounted on said frame on a forth axis parallel to said first axis, said applicator arm having an applicator adjacent to an end of said applicator arm remote from said danced arm, a co-operating cam element mounted on said applicator arm adjacent to its end remote from said applicator and positioned to engage said cam element and move said cam element and thereby said dancer arm in a clockwise direction around said second axis when said applicator arm is rotated clockwise around said fourth axis, an applicator arm guide roll forming one of said guide rolls and being rotatably mount on said application arm for rotation about a fifth axis parallel to said first axis and positioned between said fourth axis and said applicator, an exit roll forming one of said guide rolls mounted for rotation on said applicator arm on a sixth axis substantially parallel to said first axis and positioned on said applicator arm between said applicator arm guide roll and said applicator, said exit roll having a plurality of pin elements substantially parallel to said sixth axis and projecting from on axial end of said exit roll, a stop cam fixed to said frame and positioned to interact with said pin elements when said application arm is rotated clockwise so that said stop cam is in an operative position wherein said stop cam engages said pin elements to stop rotation of said exit roll.

said tape path extending from said dancer roll to said one way clutch roll and then to said application arm guide roll, then to said exit roll and from said exit roll to said applicator.

Preferably the tape supply system for a tape applicator for applying a closing tape ribbon to a carton further comprises a guide rod mounted on said frame and positioned to engage said tape ribbon

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
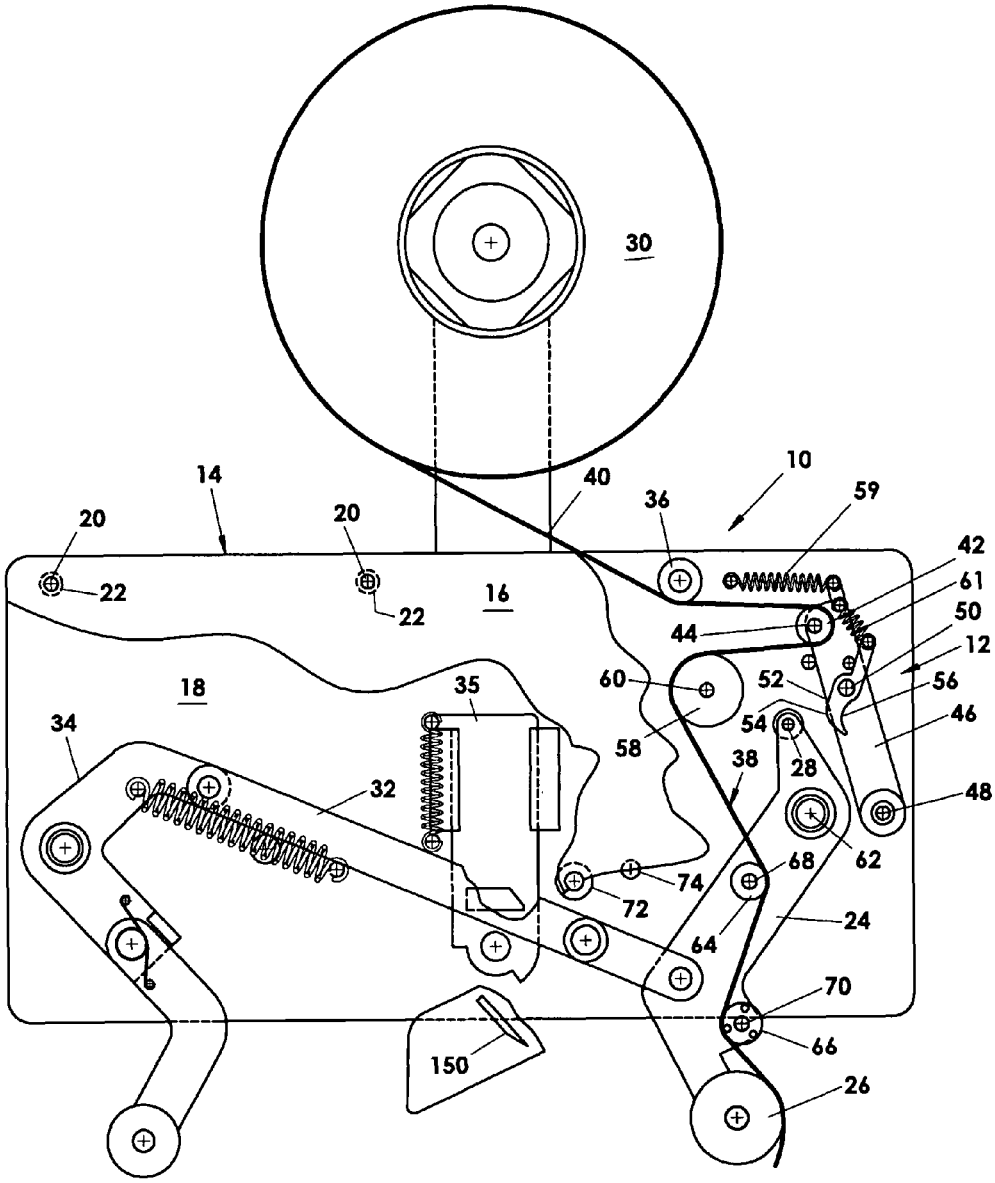
FIG. 1 is a schematic illustration with parts omitted for clarity of a multifunctional tape applicator as described in detail in U.S. patent application Ser. No. 12/318,877 filed: Jan. 12, 2009 inventor Joe Lam with the present invention incorporated therein to replace the earlier tape extender and showing the applicator arm in rest or initial position.

Turning to FIG. 1 a multifunctional tape applicator 10 with the tape supply system 12 of the present invention incorporated therein. The applicator includes a frame 14 having a pair of substantially parallel panes namely a front panel 16 and a back panel 18 connected together in spaced apart relationship by bolts 20 with spacers between the panels 16 and 18. The components of the applicator 10 are generally positioned between the panels 16 and 18 with some components mounted from the front panel 16 and others from the back panel 18 as will be described below.

Applicator as described in detail in U.S. application Ser. No. 12/318,877 filed: Jan. 12, 2009 inventor Joe Lam and includes an applicator arm 24 which at one end mounts an applicator 26 which in the illustrated version is in the form of an applicator roll and at its opposite end located adjacent to the adhesive tape source or roll 30 is a cam 28.

The remainder of the illustrated components of multifunction tape applicator includes the connecting arm interconnecting the arm 32 and the trailing arm 34 with the slide cam 35 in position to operate and have the applicator move to over travel position wherein the applicator 26 is positioned above the adjacent surface of the case 100 being processed (see FIG. 2 or 3). Full details of the applicator as indicated above are describe in the said US Patent Application The tape supply system added by the present invention includes a first guide roll 36 of a plurality of guide rolls that define a tape path 38 for a ribbon of tape 40 that is drawn from the roll 30 in the operation of the device. The roll 36 is mounted between the panels 16 and 18 of the frame 14.

The next guide roll of the plurality of guide rolls defining the tape path 38 is a dancer roll 42 which is mounted to rotate on a first axis 44 that is mounted at one end of a dancer arm 46 which in turn is mounted at its opposite end to rotate on a second axis 48. Also mounted on the dancer arm 46 for rotation on a pivotal axis 50 is a one way cam element 52 having a one way cam surface 54 and a rear surface 56. The arm 46 is biased to rotate counterclockwise (i.e. anticlockwise) about the second axis 48 by a spring 59 connecting the end of the arm 46 adjacent to the roll 42 to the frame 14 and the one way cam element 52 is biased to rotate in an anticlockwise direction around the pivotal axis 50 by a spring 61 interconnecting the arm 46 with the one way cam at a location on cam 52 on the opposite side of the pivotal axis 50 relative to the cam surface 54.

A one way clutch roll 58 i.e. a roll that can only rotate in one direction in this case only can rotate in the clockwise direction is mounted on the frame 14 to rotate on a third axis 60 and to permit the tape 40 to advance along the tape path 38 toward the applicator, but not rearward toward the tape supply roll 30 is the next guide roll defining the tape path 38.

The applicator arm 24 is pivotably mounted on the frame 14 to rotate on a fourth axis 62. Two other of the guide rolls forming the path 38 are mounted to the applicator arm 24 namely guide roll 64 and exit roll 66 which rotate on a fifth axis 68 and the sixth axis 70 respectively From the roll 58 the tape ribbon 40 passes around the guide roll 64 defining the path 38 and from there around the exit roll 66 which is positioned between the roll 64 and the applicator 26 and then to the applicator 26.

The tape ribbon 40 has its adhesive side facing and contacting the guide roll 36, the one way clutch roll 58 and the exit roll 66

It will be apparent that all of the above described axes are parallel.

Figure 2A:
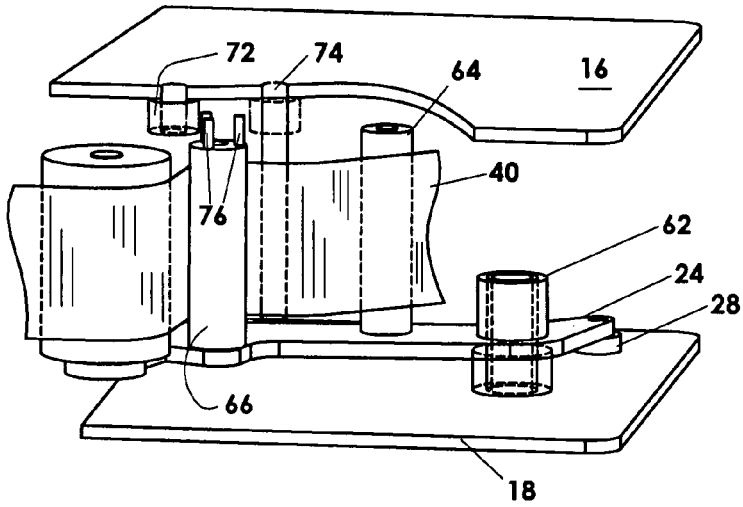
FIG. 2*a* is schematic plan isometric illustration with parts omitted for clarity showing the stop cam and exit roll.
Figure 2B:
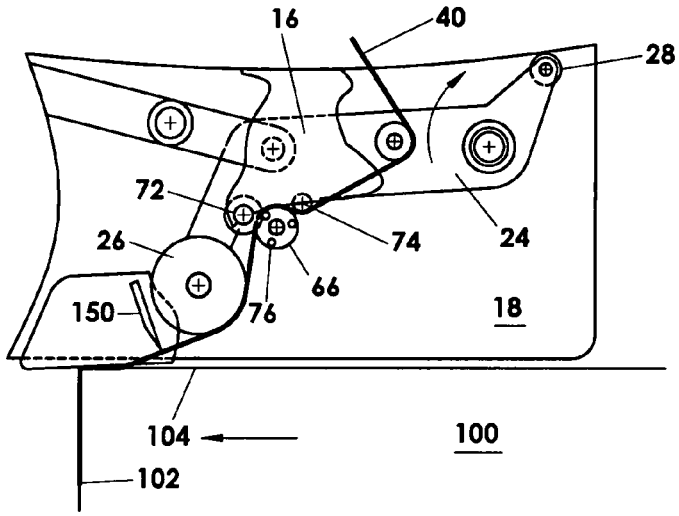
FIGS. 2*b* and 2*c* each shows a schematic side elevation with parts omitted for clarity of two different forms of stop cam and guide pin and their interaction with the exit roll when the stop cam is in position to stop rotation of the exit roll.

A stop cam 72 and guide rod 74 are mounted cantilever fashion from the front wall 16 and project toward the back wall 18 and are in position to interact with the exit roll 66 without interfering with the movement of the applicator arm 24 to an over travel position as is more clearly illustrated in FIG. 2*a*. As shown in FIG. 2*a*. the exit roller is cantilevered from the arm 24 and at its free end is provided with a plurality of axially extending pin elements 76 (three in the illustrated embodiment) symmetrically positioned around the sixth axis 70. It will be evident that the stop cam 72 engages with one of these pins 76 when the arm 24 is in over travel position as will be described below.

Figure 3A:
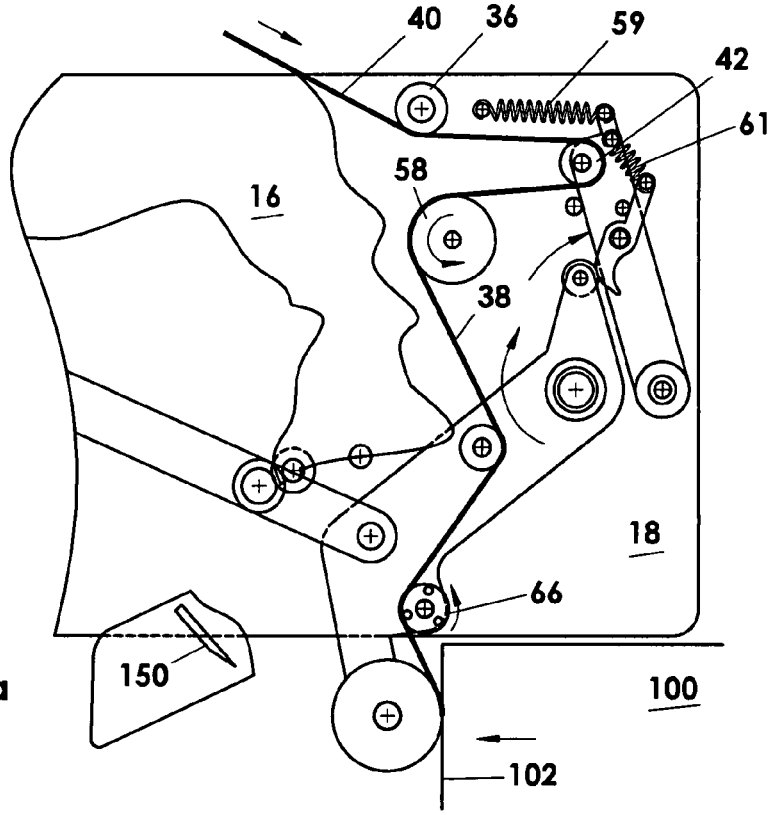
FIG. 3*a* is a schematic illustration with parts omitted for clarity showing the applicator arm in position with the applicator after initial contact with the leading face (leading in the direction of travel of a case through the machine).
Figure 3B:
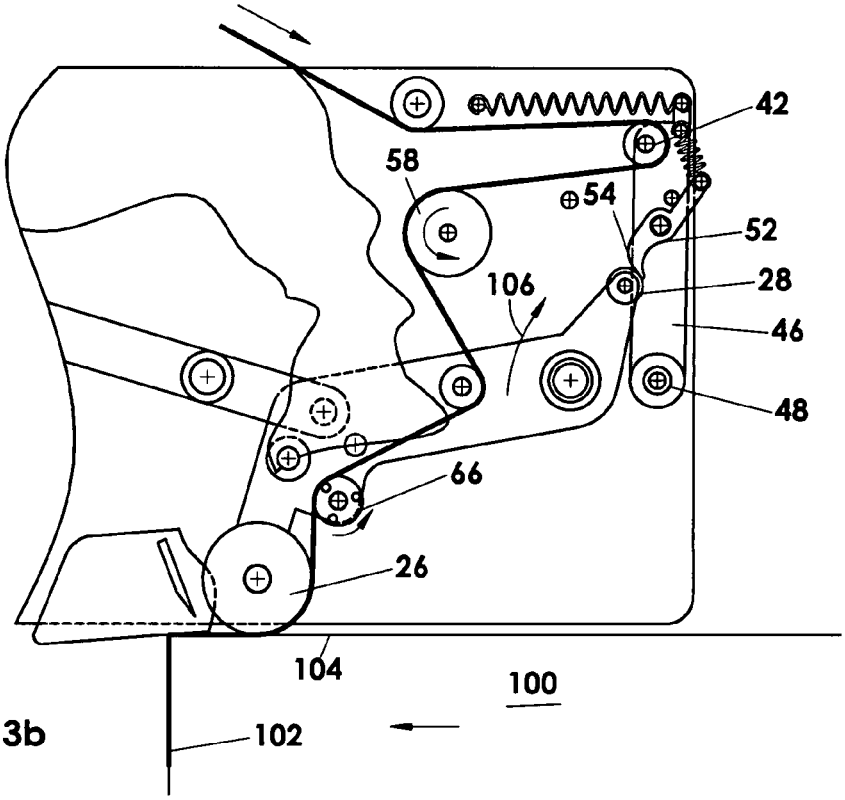
FIG. 3*b* is a schematic illustration similar to FIG. 3*a* with the applicator arm in position wherein the co-operating cam element and the cam element have engaged to rotate the dancer arm clockwise as the applicator arm is also rotated clockwise by engagement of the applicator with the case being taped.
Figure 3C:
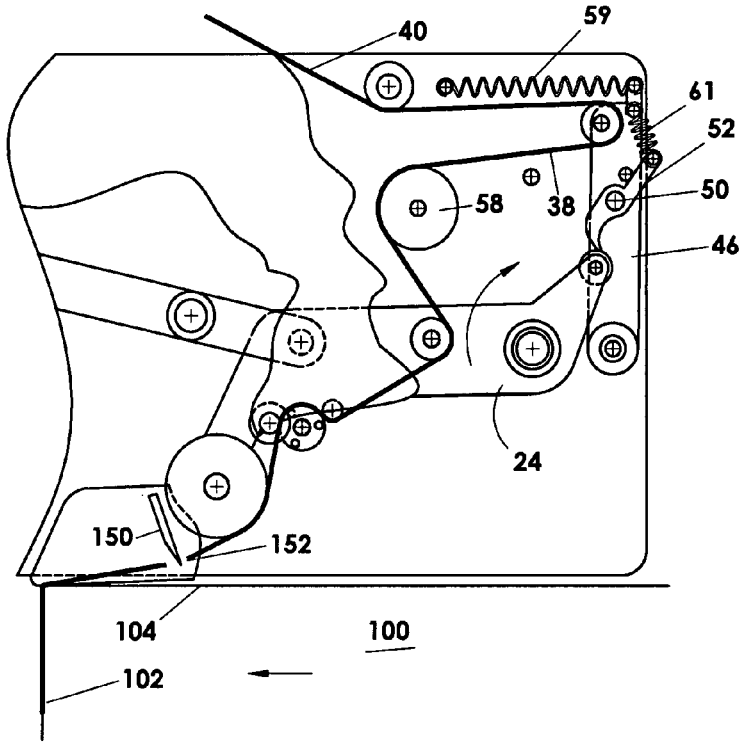
FIG. 3*c* is a schematic illustration with parts omitted showing the applicator in an advanced position relative to FIG. 3*b* wherein the co-operating cam element and the cam element are about to disengage in the over-travel position and showing the exit roller stopping the tape for cutting and completing the first L-clip taping to a case.
Figure 3D:
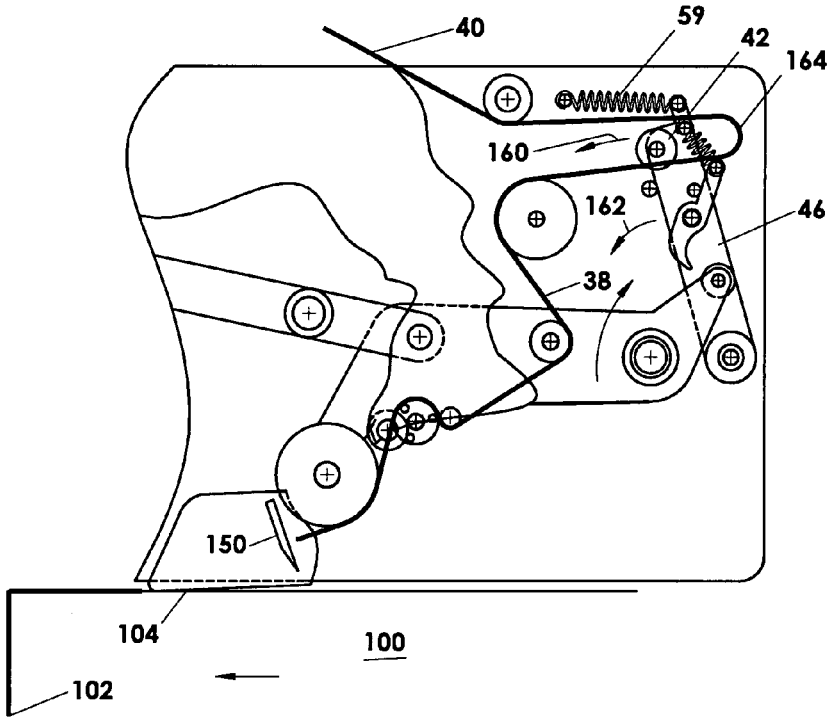
FIG. 3*d* is a schematic illustration with parts omitted showing the applicator further in the over-travel position after the application of an L-clip to a case and showing co-operating cam element and the cam element disengaged and the dancer arm rotating counterclockwise to it rest position.

The sequence of operation of the tape extender formed by the dancer roll 42 and its mounting for relative movement to the frame 14. As shown in FIG. 3*a* at the commencement of the taping operation the case 100 being closed is moved against the applicator 26 which in the illustrated arrangement is in the form of a roll that wipes the leading end of the tape ribbon 40 against the leading face 102 of the case with the adhesive side of the tape 40 in contact with the leading face 102 of the case 100. As the case is advanced the applicator moves over the top (or bottom depending on the orientation of the case relative to the applicator) 104 of the case 100 which forces the arm 24 to rotate in a clockwise direction as indicated by the arrow 106 in FIG. 3*b* which moves the cam 28 against the cam face 54 of the cam 52 and forces the cam 52 and the dancer arm 46 to rotate clockwise about axis 48 and thereby move the dancer roll away from the one way clutch roll 58 and extend the length of the tape path 38 between the tape roll 30 and the roll 58 to provide an extended length of tape 40. Next the arm 24 is moved toward over travel position as shown in FIG. 3*c* and the cut off knife 150 is positioned to cut and cuts the ribbon 40 as indicated at 152 to apply and L-clip tape to the leading corner of the case 100. In this position the cam 28 is about to clear the cam face 54 of the cam 52 and the dancer roll 42 is in its fully extended position stretching the spring 59 and maximizing the length of the tape path 38 between the tape roll 30 and the one way clutch roll 58. In FIG. 3*d* the arm 24 has reached full over travel position with the applicator 26 well above the top 104 of the case 100 and the cam 28 is clear of the cam face 54 of the cam 52 and the spring 59 contracts bringing the dancer roll 42 and arm 46 back to their starting positions as indicated by the arrows 160 and 162 and providing slack in the tape 40 as indicated at 164.

Figure 3E:
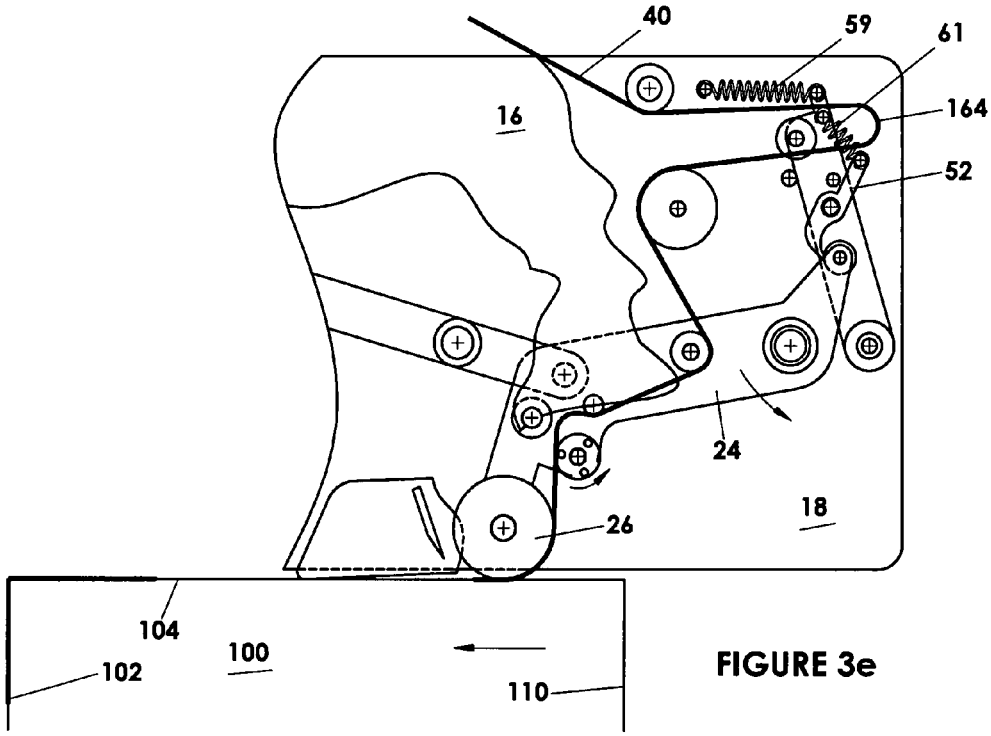
FIG. 3*e* is a schematic illustration similar to FIG. 3*d* showing the applicator arm at the start of its counterclockwise rotation as the applicator arm is returning from its over travel position to apply the second L-clip.
Figure 3F:
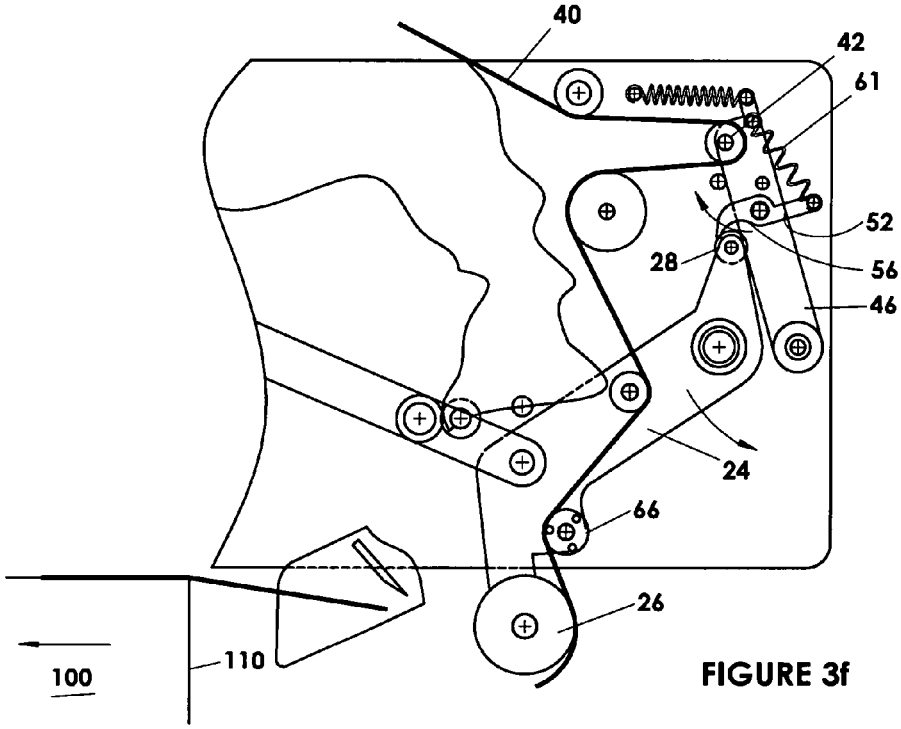
FIG. 3*f* is a schematic illustration similar to FIG. 3*d* showing the applicator arm as the applicator arm is returning from its taping position toward its initial position after tape cutting and case has cleared.

In the illustrated system the arm 24 is then moved to the top 104 of the of the case 100 and a L-clip is applied to the trailing end 110 of the case 100 as described in full in the said US Patent Application (see FIG. 3*e* and the slack 164 is used to begin the formation of this L-clip applied along the top 104 of the case 100 adjacent to the trailing end 110 of the case. After the applicator 26 clears the trailing end 110 of the case 100 it returns to the starting position and in so doing the cam 28 engages the rear face 56 of the cam element 52 and moves same against the resistance of the spring 61 (see FIG. 3*f*) so that the arm 24 can return to starting position as shown n FIG. 3*a*.

When the arm 24 is in over travel position the stop cam 72 engages the pins 76 to prevent rotation of the exit roll 66 and to which the adhesive side of the tape 40 is adhered to stop movement of the tape 40 to permit proper cutting of the tape by the knife 150. The rod 74 forces the tape 40 to more fully surround the exit roll 66 and thereby increase the area of contact between the adhesive tape 40 and the exit roll 66 (see FIG. 2*b* and FIGS. 3*c* and 3*d*).

Figure 2C:
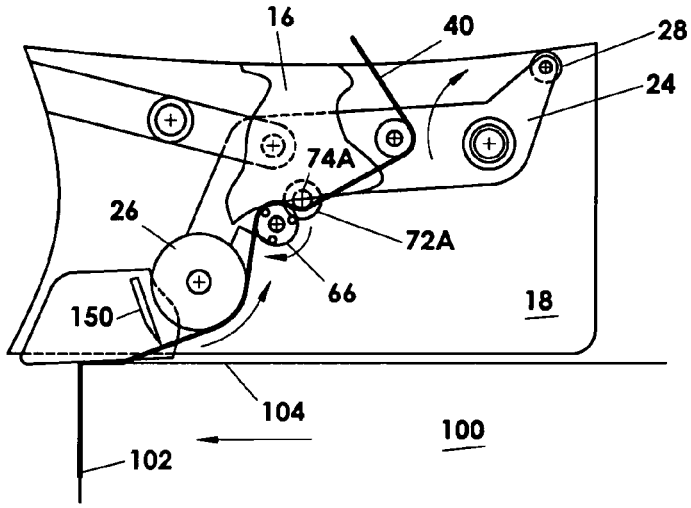

FIG. 2*c* shows a modification of the breaking cam 72A and rod 74A (equivalent to the cam 72 and rod 74) wherein the two are substantially concentric and position on the up-stream side of the exit roll 66 which permits exit roll 66 to rotate clockwise for more tape cutting tension.

Having described the invention, modifications will be evident to those skilled in the art without departing from the scope of the invention as defined in the appended claims.

I claim:

1. A tape supply system for a tape applicator for applying a closing tape ribbon to a carton comprising a frame for said tape applicator, a source of tape, a plurality of guide rolls arranged to define a tape path for a tape ribbon from said tape supply to an applicator for applying said tape to said carton, one of said guide rolls being a dancer roll mounted to rotate on a first axis mounted on a dancer arm adjacent to one end of said dancer arm, said dancer arm being pivotably mounted on said frame on a second axis parallel to said first axis and positioned spaced from said first axis, a spring biasing said dancer arm to rotate on said second axis, a cam pivotably mounted on a pivotal axis on said dancer arm and located between said first and second axis and a second spring biasing said cam to rotate on said pivotal axis, a one way clutch roll pivotably mounted on said frame on a third axis parallel to said first axis, said one way clutch roll permitting rotation to permit movement of said tape along said tape path from said tape supply toward said applicator, an applicator arm pivotably mounted on said frame on a forth axis parallel to said first axis, said applicator arm mounting said applicator adjacent to an end of said applicator arm remote from said dancer arm, a co-operating cam element mounted on said applicator arm adjacent to its end remote from said applicator and positioned to engage said cam and move said cam and thereby said dancer arm in a clockwise direction around said second axis when said applicator arm is rotated clockwise around said fourth axis, an applicator arm guide roll forming one of said guide rolls and being rotatably mount on said application arm for rotation about a fifth axis parallel to said first axis and positioned between said fourth axis and said applicator, an exit roll forming one of said guide rolls mounted for rotation on said applicator arm on a sixth axis substantially parallel to said first axis and positioned on said applicator arm between said applicator arm guide roll and said applicator, said exit roll having a plurality of pin elements substantially parallel to said sixth axis and projecting from on axial end of said exit roll, a stop cam fixed to said frame and positioned to interact with said pin elements when said application arm is rotated clockwise so that said stop cam is in an operative position wherein said stop cam engages said pin elements to stop rotation of said exit roll, said tape path extending from said dancer roll to said one way clutch roll and then to said application arm guide roll, then to said exit roll and from said exit roll to said applicator.

2. A tape supply system for a tape applicator for applying a closing tape ribbon to a carton as defined in claim 1 further comprises a guide pin mounted on said frame and positioned to engage said tape ribbon.

* * * * *